US012704329B2

(12) United States Patent
Lewis

(10) Patent No.: US 12,704,329 B2
(45) Date of Patent: Aug. 11, 2026

(54) ENERGY RECOVERY SYSTEM

(71) Applicant: Sherwin Lewis, Miami, FL (US)

(72) Inventor: Sherwin Lewis, Miami, FL (US)

( * ) Notice: Subject to any disclaimer, the term of this patent is extended or adjusted under 35 U.S.C. 154(b) by 147 days.

(21) Appl. No.: 18/619,432

(22) Filed: Mar. 28, 2024

(65) Prior Publication Data

US 2025/0305774 A1 Oct. 2, 2025

(51) Int. Cl.

| | |
|---|---|
| ***F28D 20/00*** | (2006.01) |
| ***F24F 1/06*** | (2011.01) |
| ***F28D 21/00*** | (2006.01) |
| ***F28F 9/00*** | (2006.01) |

(52) U.S. Cl.

CPC ..... *F28D 20/0034* (2013.01); *F24F 1/06* (2013.01); *F28D 21/0014* (2013.01); *F28F 9/002* (2013.01)

(58) Field of Classification Search

CPC .. F28F 9/002; F28D 20/0034; F28D 21/0014; F24F 1/06

See application file for complete search history.

(56) References Cited

U.S. PATENT DOCUMENTS 4,044,726 A * 8/1977 Reichmann ..... F24H 1/52 122/367.3
4,241,588 A * 12/1980 Murphy ..... F24D 17/02 62/238.1
4,441,902 A 4/1984 Jardine
4,558,571 A * 12/1985 Yoshinaga ..... F25B 29/003 62/506
4,791,790 A 12/1988 Tongu
4,872,319 A 10/1989 Tongu
5,003,788 A * 4/1991 Fischer ..... F25D 21/12 62/238.7
5,367,602 A * 11/1994 Stewart ..... F24D 19/1054 392/308
5,911,747 A * 6/1999 Gauthier ..... F24F 11/30 62/93
6,357,245 B1 3/2002 Weng et al.
6,799,539 B2 10/2004 Suenaga et al.
9,605,882 B2 * 3/2017 Hancock ..... F25B 49/02

(Continued)

FOREIGN PATENT DOCUMENTS

CN 204830365 U * 12/2015 ..... F24F 12/00
CN 108662682 A * 10/2018 ..... F25B 39/04
JP 2002061886 A * 2/2002

OTHER PUBLICATIONS

Translation of CN204830365U named Translation-CN204830365U (Year: 2015).*

(Continued)

*Primary Examiner* — Paul Alvare
(74) *Attorney, Agent, or Firm* — Dunlap Bennett & Ludwig PLLC

(57) ABSTRACT

An energy recovery system for a pre-existing condenser unit is provided. The energy recovery system provides a casing housing a coil fin, an external water source fluidly coupled to the coil fin, and the casing directly connected to the pre-existing condenser unit so that latent heat output from the pre-existing condenser unit interfaces with the coil fin for heating the external water by way of heat transfer. The energy recovery system is self-activating by electrically coupling a transformer of the energy recovery system to a power source of the pre-existing condenser.

2 Claims, 3 Drawing Sheets

(56) References Cited

U.S. PATENT DOCUMENTS

| | | | | |
|---|---|---|---|---|
| 9,702,634 | B1 | 7/2017 | Mankaruse | |
| 9,945,616 | B1 * | 4/2018 | Wingen | F23J 15/06 |
| 10,072,856 | B1 * | 9/2018 | Akin | F24F 5/0046 |
| 10,101,037 | B2 | 10/2018 | Parvin et al. | |
| 10,178,937 | B2 | 1/2019 | Mills et al. | |
| 10,801,761 | B2 | 10/2020 | Dobson | |
| 11,162,706 | B2 | 11/2021 | Bhosale et al. | |
| 11,162,723 | B2 | 11/2021 | Wang et al. | |
| 11,268,722 | B2 | 3/2022 | Ferrere et al. | |
| 2002/0088239 | A1 * | 7/2002 | Goldstein | F24F 5/001 62/93 |
| 2007/0295018 | A1 | 12/2007 | Williams | |
| 2009/0026281 | A1 | 1/2009 | McGreevy | |
| 2012/0292008 | A1 | 11/2012 | Goldberg | |
| 2015/0362207 | A1 * | 12/2015 | Abiprojo | F24F 11/67 702/183 |
| 2020/0049426 | A1 | 2/2020 | Kolenko | |
| 2021/0123615 | A1 * | 4/2021 | Ball | F24F 3/1405 |

OTHER PUBLICATIONS

Translation of CN108662682A named Translation-CN108662682A (Year: 2018).*

Translation of JP-2002061886-A named Translation-JP-2002061886-A (Year: 2002).*

* cited by examiner

ENERGY RECOVERY SYSTEM

BACKGROUND OF THE INVENTION

The present invention relates to heat transfer systems and, more particularly, to an energy recovery system for condenser units.

Heating, ventilating, and air-conditioning (HVAC) systems are configured to maintain desirable temperatures within residential and commercial structures to provide comfortable and safe environments for occupants to live and work.

As such, HVAC systems involve heat transfer (e.g., required when air conditioning an interior space) and typically have a condenser or heat exchanger used to condense a gaseous substance into a liquid state through cooling. In so doing, the latent heat is released by the substance and transferred to the surrounding environment.

A condenser is designed to transfer heat from a working fluid (e.g. refrigerant in an air conditioning unit) to a secondary fluid or the surrounding air. The condenser relies on the efficient heat transfer that occurs during phase changes, e.g., during the condensation of a vapor into a liquid. The vapor typically enters the condenser at a temperature above that of the secondary fluid. As the vapor cools, it reaches the saturation temperature, condenses into liquid, and releases large quantities of latent heat.

During the air condition cycle of an HVAC system, heat is wasted at this condensation phase since HVAC-system condensers dispel latent heat into the atmosphere.

As can be seen, there is a need for an energy recovery system for condenser units, recovering energy lost during the normal condenser operation and reusing it for various tasks.

SUMMARY OF THE INVENTION

The system embodied by the present invention captures latent heat of condensers and uses it for domestic hot water, heating pools, heating spas, or the like, thereby reducing a user's utility cost and lowering electrical consumption.

The present invention is adapted to attach to the outlet of any existing condenser unit and not interfere with the normal operation while saving the owner up to 100% on their utility heating cost.

In one aspect of the present invention, a method of recovering latent heat of a condenser unit includes the following: fluidly coupling a coil fin to an outlet of the condenser unit, wherein the latent heat is flow through said outlet; and directly connecting a housing of the coil fin to the condenser unit, wherein the coil fin receives water that the coil fin is configured to transfer heat from the latent heat to said water by way of heat transfer; further including electrically connecting a transformer operatively associated with the coil fin to a power source of the condenser unit, whereby the transformer is self-activated by the power source; and still further including operatively associating a temperature sensor to a valve by way of a control panel, wherein the valve fluidly couples said water to the coil fin, wherein the temperature sensor senses a temperature of the latent heat at said outlet, and wherein the control panel is configured to bypass, by way of the valve, fluid coupling of said water to the coil fin if a predetermined temperature of the latent heat is not sensed, wherein directly connecting the housing to the condenser unit comprises clamping the housing to the condenser unit.

In another aspect of the present invention, an energy recovery system for a pre-existing condenser unit includes the following: a casing housing a coil fin; an external water source fluidly coupled to the coil fin; and the casing directly connected to the pre-existing condenser unit so that latent heat output from the pre-existing condenser unit interfaces with the coil fin; further including clamps directly connecting the casing to the pre-existing condenser unit; and further including a control panel providing the following: a transformer electrically powering the coil fin; an air temperature sensor configured to sense temperature of the latent heat output; a temperature sensor configured to sense temperature of the external water source; a water inlet through which the externa water source enters the coil fin; a valve operatively associated with the water inlet; and a thermostat, wherein the control panel is configured to bypass, by way of the valve, fluid coupling of said water to the coil fin if a temperature of the external water is greater than or equal to a temperature of the latent heat, wherein the control panel further comprises a transformer electrically powering the coil fin, and wherein the transformer is electrically connected to a power source of the pre-existing condenser unit, whereby self-activation is enabled.

These and other features, aspects and advantages of the present invention will become better understood with reference to the following drawings, description and claims.

DETAILED DESCRIPTION OF THE INVENTION

Figure 1:
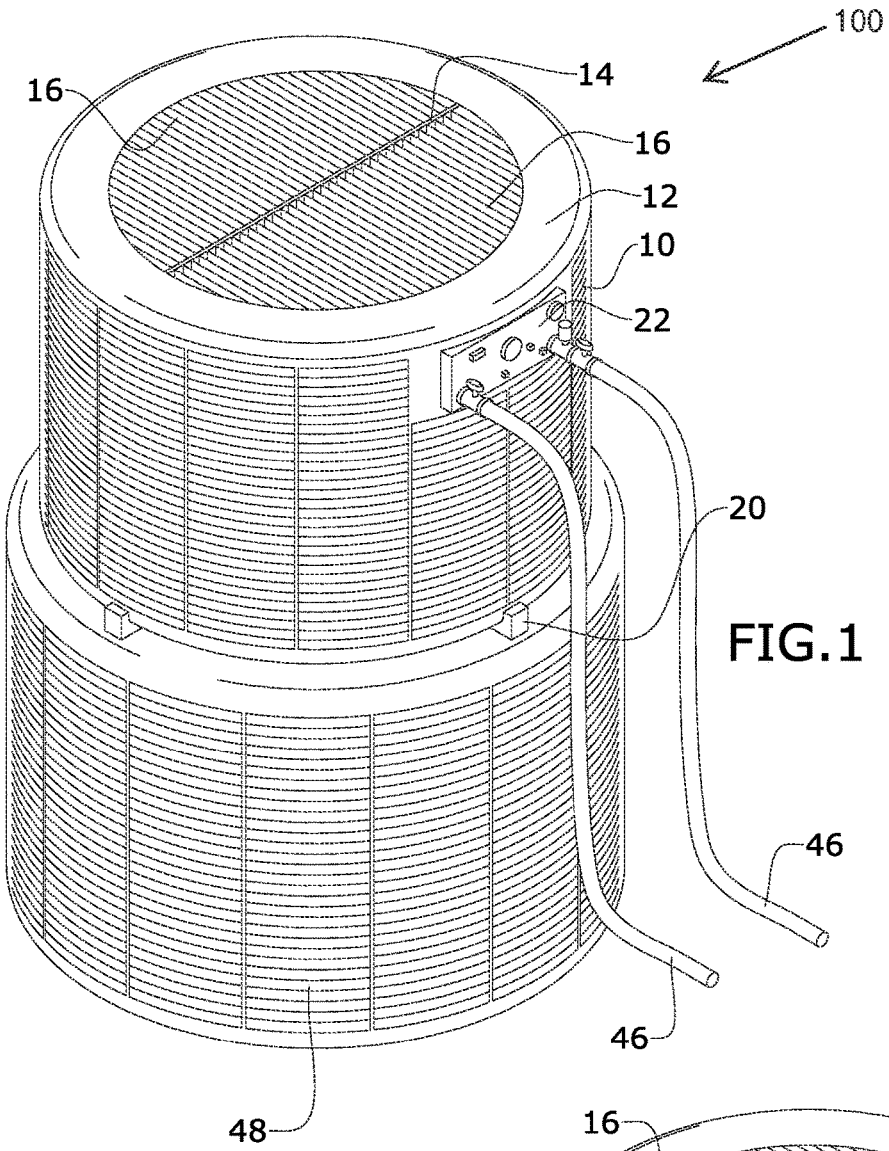
FIG. 1 is a perspective view of an exemplary embodiment of the present invention, shown in use, wherein the energy recovery system 100 is fluidly coupled to an outlet (not shown) of a pre-existing condenser unit 48 by being directly connected to the latter so as to capture the latent heated air thereof, whereby this captured heat is used to increase the temperature of a separate water source (not shown).
Figure 2:
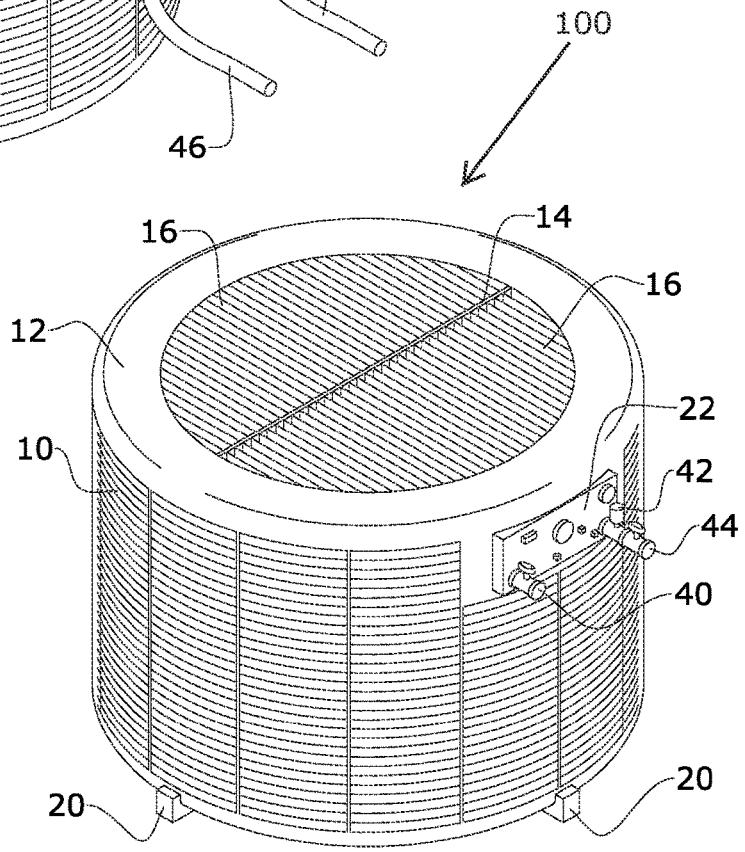
FIG. 2 is a perspective view of an exemplary embodiment of the present invention.
Figure 3:
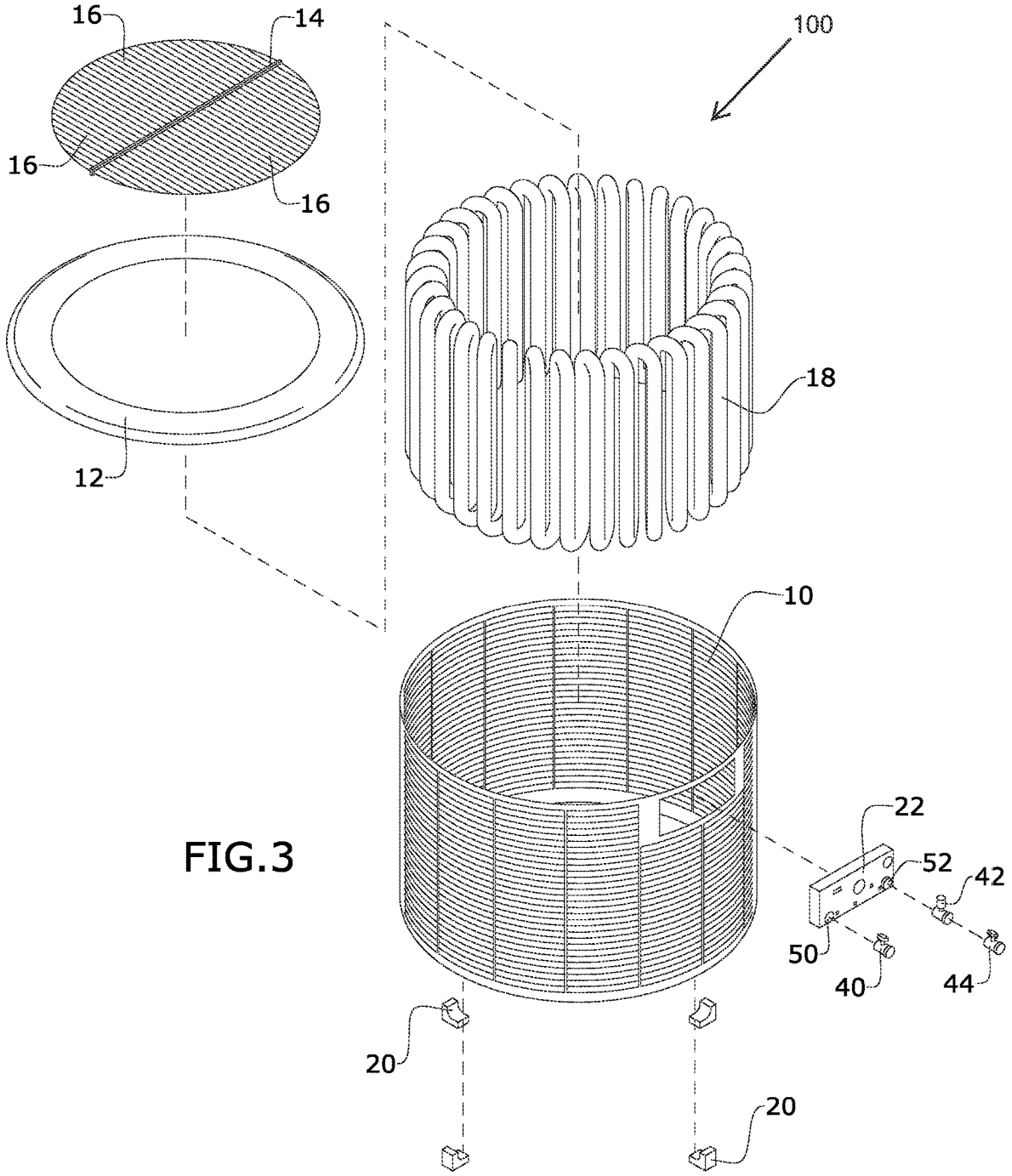
FIG. 3 is an exploded perspective view of an exemplary embodiment of the present invention.
Figure 4:
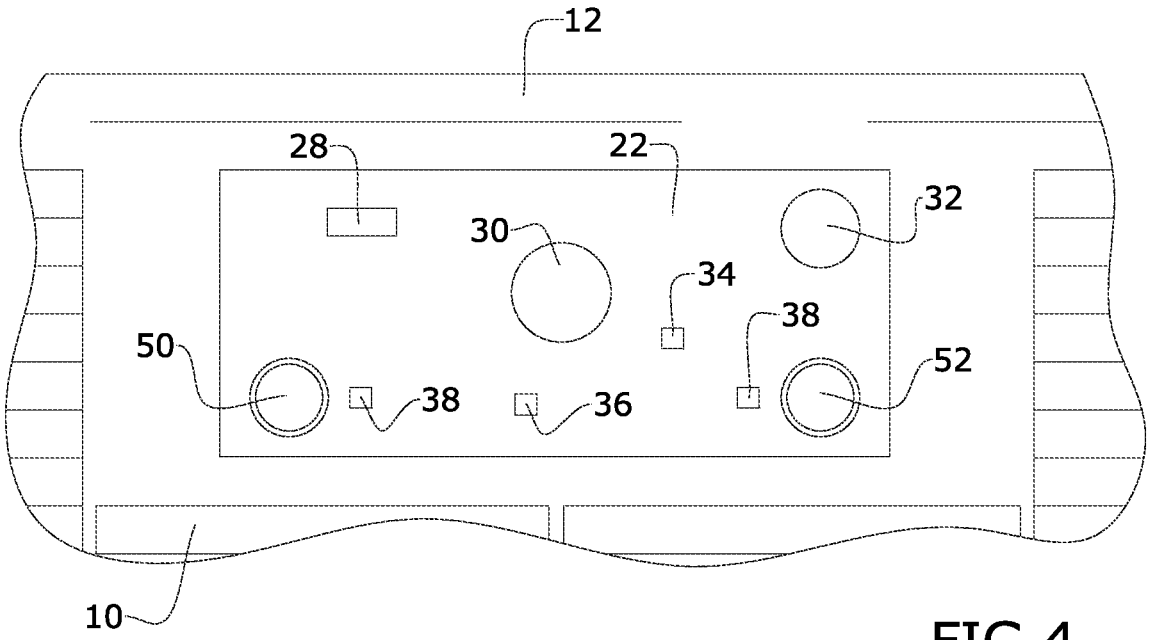
FIG. 4 is a detailed view of a control panel of an exemplary embodiment of the present invention.
Figure 5:
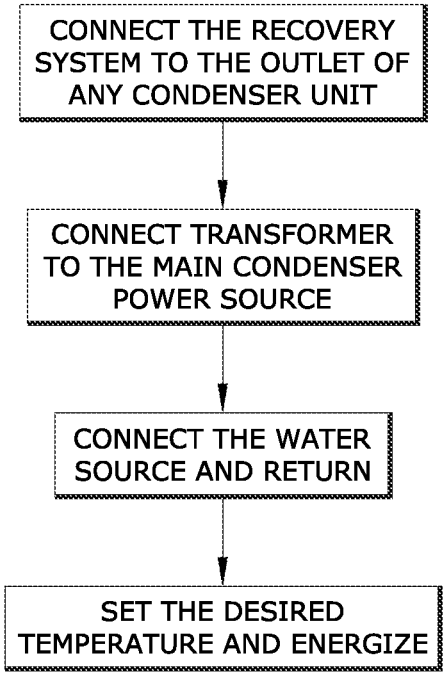
FIG. 5 is a flow chart of an exemplary embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides an energy recovery system for condenser units.

Referring to the Figures, the energy recovery system 100 may include a casing 10 dimensioned and shaped to house a coil fin 18. The top portion 12 of casing 10 may include a damper control arm 14 and a plurality of damper blades 16 operatively associated with the damper control arm 14.

Along the surface of casing 10, a cutout may be provided to retain a control panel 22 therein. Control panel 22 may have a water inlet 50 and a water outlet 52. Fluidly coupled to the water inlet 50 is a shut off valve 40. Fluidly coupled to the water outlet 52 is an automatic valve 42 and a safety valve 44. Control panel 22 may provide a transformer 32, an air flow sensor 34, air temperature sensors 36, temperature sensors 38, a damper actuator 30, a thermostat 28. The damper actuator 30 is adapted to divert air through the coil on demand, thereby allowing free flow of air when there is no demand for hot water or temperature is satisfied.

The energy recovery system 100 is physically connected to a condenser unit 48 of a HVAC system by way of clamps 20 or any suitable connectors. A user of the present invention can connect the water inlet 50 of the energy recovery system 100 to an outlet of the condenser unit 48. Then the user of the condenser unit 48 may operatively associate the transformer 32 of the energy recovery system 100 to the power source of the condenser unit 48. Also, the user connects a water source line 46 and a return water line 46 via the water inlet 50 and/or the water outlet 52, respectively, of the energy recovery system 100 to one or more external water sources (not shown).

The coil fin 18 embodied in the energy recovery system 100 experiences the latent heat captured from the condenser unit 48. The coil fin 18 receives cold water from an external water source via the water inlet 50 on the control panel 22, and the coil fin 18 removes heat from the captured latent heated air of the condenser unit 48 transfers—via air through heat transfer—that heat to the received water, raising the received water's temperature. This heated water is then either stored outside the energy recovery system 100 or used for other purposes via the water outlet 52 of the control panel.

The combination of the temperature sensor 38 and the automatic valve 42 and the safety valve 44 is configured to ensure that water flow through the coil fin 18 will be bypassed if the latent heat of the condenser unit 48 is below a certain threshold or below the temperature of the water source, as there would be no positive heat to transfer from the air to the water.

By the transformer of the energy recovery system 100 being electrically coupled to the power source of the condenser unit 48, self-activation of the energy recovery system 100 is enabled. The user can employ the sensors 34, 36, and 38 and thermostat 28 for selectively controlling set points as to when the damper functionality and energization is activated and deactivated. Water valves 40, 42, and 44 effectuate the flow and thermostat monitor setpoints.

This energy recovery system 100 recovers energy lost during the normal operation of a pre-existing condenser unit 48 by capture its latent heat and using it for various tasks as opposed to let the latent heat be wasted into the air of the external environment. Through the setting of the systemic sensors 34, 36, and 38, which measure condenser and inlet water temperatures, and thermostat 28, the energy recovery system 100 is configurable to engage when heat is detected from the condenser unit 48.

Depending on the application, the circular coil size of the coil fins is selected to match the condenser unit 48. An optional storage tank for storing the hot water extracted from the energy recovery system 100 may be fluidly coupled to the water return line 46 and/or water outlet 52 of the control panel 22/energy recovery system 100.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. An energy recovery system for a pre-existing condenser unit, the energy recovery system comprising:

a casing housing a coil fin;

an external water source fluidly coupled to the coil fin;

the casing directly connected to the pre-existing condenser unit so that latent heat output from the pre-existing condenser unit interfaces with the coil fin so that the coil fin heats the external water;

clamps directly connecting the casing to the pre-existing condenser unit;

a transformer electrically powering the coil fin;

an air temperature sensor configured to sense temperature of the latent heat output;

a temperature sensor configured to sense temperature of the external water source;

a water inlet through which the external water source enters the coil fin; and a valve operatively associated with the water inlet;

wherein the control panel is configured to bypass, by way of the valve, fluid coupling of said water to the coil fin if a temperature of the external water is greater than or equal to a temperature of the latent heat.

2. The energy recovery system of claim 1, wherein the control panel further comprises a transformer electrically powering the coil fin, and wherein the transformer is electrically connected to a power source of the pre-existing condenser unit, whereby self-activation is enabled.

* * * * *